United States Patent [19]

Cavallarin

[11] 4,311,176

[45] Jan. 19, 1982

[54] MACHINE FOR MANUFACTURING CURVILINEAR CONVEX WOODEN FRAMES

[75] Inventor: Fiore B. Cavallarin, Venice, Italy

[73] Assignee: Closeform S.r.l., Venice, Italy

[21] Appl. No.: 173,386

[22] Filed: Jul. 29, 1980

[30] Foreign Application Priority Data

Mar. 4, 1980 [IT] Italy ..... 84118 A/80

[51] Int. Cl.[3] ..... B27H 1/00

[52] U.S. Cl. ..... 144/268; 156/184; 156/189; 156/352

[58] Field of Search ..... 144/267, 268, 270; 156/166, 173, 184, 186, 187, 189, 446, 457, 352, 360

[56] References Cited

U.S. PATENT DOCUMENTS

| | | | |
|---|---|---|---|
| 1,933,834 | 11/1933 | Wimer | 144/268 |
| 1,954,183 | 4/1934 | Schlesinger | 144/268 |
| 2,655,187 | 10/1953 | Moe | 144/268 |
| 3,328,219 | 6/1967 | Cupery | 156/189 |
| 3,788,916 | 1/1974 | Gadelius | 156/184 |

*Primary Examiner*—W. D. Bray

*Attorney, Agent, or Firm*—D. Paul Weaver

[57] ABSTRACT

A machine for manufacturing curvilinear convex wooden frames includes a base frame having a feeding bench mounted thereon over which is fed a continuous wooden strip which is wound up on a revolving pattern to form a rough frame of the desired thickness. The feeding bench is movable relative to the base frame and its movement is coordinated with the revolving pattern under control of a power cylinder to maintain the surface of the feeding bench tangent at all times to the revolving pattern.

12 Claims, 2 Drawing Figures

MACHINE FOR MANUFACTURING CURVILINEAR CONVEX WOODEN FRAMES

BACKGROUND OF THE INVENTION

Machines for manufacturing round wooden frames are known in the prior art and they comprise a base frame on which a feeding bench and a circular pattern are mounted. A continuous thin wooden strip is wound around the revolving pattern until a rough frame of the desired thickness is obtained. This rough frame is then sent on to subsequent finishing operations.

As the extraction of the rough frame from the pattern is made possible in the prior art by the radial contraction of the pattern, the latter is generally formed as a cylinder from a thin metal plate, open along a generating line and fixed to a central hub. The cylindrical surface of this pattern is resiliently contracted, in the resting condition, and is expanded prior to the winding of the thin wooden strip, either by extending the rods connecting the surface to the hub, or by frontally applying circular discs having a conical profile.

While such known machines successfully produce circular one piece wooden frames, they possess certain drawbacks and limitations, among which are:

(1) The fact that it is difficult to manufacture very thick frames. In fact, the wide variation in distance between the axis of the revolving pattern and the point of tangency of the wooden strip therewith, causes undesired bending of the strip and possible breaking of the same.

(2) The fact that the resiliency of the cylindrical pattern is concentrated on a short section of its side surface. This involves the transmission of high dynamic stresses to the rods connected with the hub, and the possible loss of a perfect cylindrical shape during the expansion of the pattern. Moreover, the known machines cannot satisfactorily produce oval frames instead of round ones.

(3) During strip winding, the wooden strip is submitted to continuous bendings, due to variations in the distance between the point of tangency and the axis of the revolving pattern, with the resulting possibility of breaking the strip.

(4) To maintain the oval configuration of the pattern, when expanding the latter, it is necessary to use discs having a conical profile. The manufacturing of such discs is expensive and laborious.

The above deficiencies become even greater if the curvilinear frame being produced requires a shape different from cylindrical or from oval. With the prior art drawbacks in mind, the present invention seeks to provide a machine for efficiently manufacturing convex wooden frames of any required thickness and any curvilinear convex shape.

Other features and advantages of the invention will become apparent during the course of the following detailed description.

SUMMARY OF THE INVENTION

To accomplish the objectives of the invention, a machine for manufacturing curvilinear convex wooden frames comprises a base frame, on which a feeding bench for a continuous wooden strip and a revolving form or pattern for the strip are mounted. The strip is continuously wound on the pattern to produce a rough frame of required thickness while the feeding bench performs a twofold movement with respect to the base frame. First, it moves continuously away from the rotational axis of the pattern, due to the increasing thickness of the frame being produced, and, secondly, it periodically swings in a synchronized manner with the revolving of the pattern, the feeding bench being provided with means to maintain the feeding plane of the wooden strip constantly tangent to the pattern.

In accordance with the invention, the feeding bench may be joined to the base frame at a different point from the tangency point of the strip with the revolving pattern. Preferably, the feeding bench carries a pressing roller engaging the wooden strip at its point of tangency with the revolving pattern. The pressing roller may be placed within a small glue tank, equally supported by the feeding bench to form the distributing member of the glue on the external surface of the wooden strip.

Always, according to the invention, the revolving pattern comprises a thin metal plate, open along a generating line and secured to a central hub by articulated rods, each consisting of at least two sections. Preferably, the two ends of the side surface of the revolving pattern are connected to each other by means of a connecting rod and cam. The machine may be provided with a switch to stop the revolving pattern when the rough frame reaches a given thickness. This switch may be formed by a thickness feeler, operating on the lower dead center of the swinging movement of the bench.

DETAILED DESCRIPTION

Figure 1:
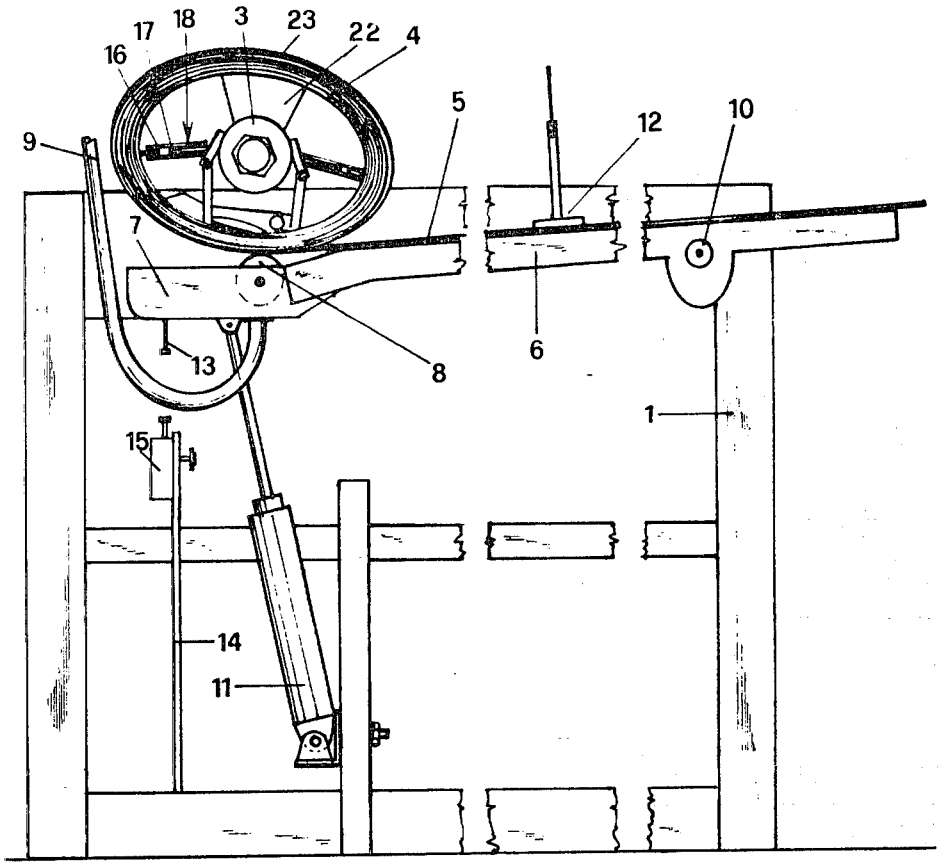
FIG. 1 is a fragmentary side elevation of a machine for manufacturing curvilinear convex wooden frames in accordance with the invention.
Figure 2:
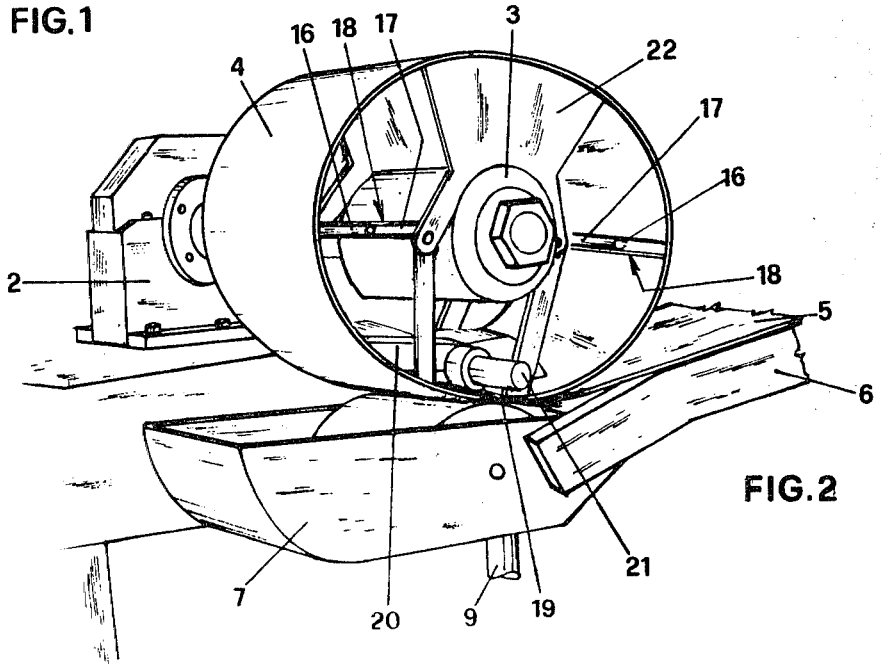
FIG. 2 is an enlarged fragmentary perspective view of the revolving pattern and associated elements.

Referring to the drawings in detail, wherein like numerals designate like parts, the numeral 1 designates a base frame of the machine, supporting an electric motor 2, the shaft of which is integral with the hub 3 of a pattern 4, on which is wound a thin wooden strip 5 drawn from a supply reel, not shown, located remotely from the pattern. The pattern 4 is illustrated as being oval or elliptical in the drawings but its shape may vary.

A guiding and feeding bench 6 for the strip 5 is joined to the base frame 1 and carries at its free end a small glue tank 7 having a distributing roller 8 and being fed with glue by gravity by a pipe 9. The bench 6 is pivoted to the base frame 1 as at 10 at a point distant from the tank 7, and is further supported beneath the tank by a pneumatic cylinder or jack 11. The cylinder body is fixed to the base frame 1 by means which allows the height of the cylinder to be adjusted.

On the upper surface of the feeding bench 6 is placed a brake shoe 12 which maintains the wooden strip 5 under a constant tension during its winding.

At the swinging end of the bench 6 beneath tank 7 is a depending element 13 cooperating with an upright rod 14 fixed to base frame 1, said rod supporting a limit stop electrical switch 15 whose height is adjustable on the rod 14.

The peripheral or side surface of the pattern 4 is connected to the hub 3 by rods 18, each consisting of two sections 16 and 17, articulated to each other, to the side surface of the pattern, and to the hub 3. Moreover, the side surface of the pattern is open along a generating line, forming a slit 19, the two margins of which are connected to each other by means of a rod 20 hinge-joined to either border, and fixed to a cam 21 attached to the other border or margin of the side surface. Additionally, the side surface of the pattern 4 is connected to the hub 3 by a pair of parallel sector plates 22 at the opposite ends of the hub 3.

The machine operates in the following manner:

The end of the thin wooden strip 5 resting on the feeding bench 6 is connected in the slit 19 of the revolving pattern 4. The motor 2 is activated to start the revolving of the pattern, thus dragging the strip 5 forwardly to begin winding it around the pattern. During the winding of the wooden strip, the pneumatic jack 11 resiliently presses the roller 8 against the wooden strip at its point of tangency with the pattern 4. The roller 8 operates in a three-fold manner.

First, it distributes glue from the tank 7 over the entire external surface of the strip 5. Second, the roller 8 presses the strip 5 against the previously-wound layer having glue on its external surface. Third, the roller forces the bench 6 to pivot around the axis of pivot element 10, thus maintaining the top surface of the bench continuously tangent to the exterior of the revolving pattern.

The oscillations performed by the free end of the bench 6 are synchronous with the revolutions of the pattern 4, have a constant amplitude, but the lower dead center of the bed increases gradually in distance from the axis of hub 3 as each layer of the strip 5 is wound on the pattern to gradually increase the thickness of the rough wooden frame being formed. Therefore, on each revolution of the pattern 4, the projecting element 13 of the bench lowers its dead center swing slightly and at a predetermined time, when the desired thickness of the wooden frame is reached, opens the limit switch 15, stopping the drive motor 2. The height of the switch 15 is precisely adjusted beforehand to assure stopping of the drive motor only when a wooden frame of desired thickness has been completed.

When the pattern 4 comes to a stop, the operator severs the strip 5 and provisionally secures its end to the rough frame 23. He then lowers the roller 8, and with a suitable key bends the articulated rods 18. By rotating the cam 21, the operator causes contraction of the pattern 4 so that the wooden frame 23 can be removed from it. Finally, the operator repeats these operations in the opposite order, to prepare the machine for another operating cycle.

From what has been stated, it clearly appears that in the machine the wooden strip 5 is always held tangent to the side surface of the pattern 4 on which the strip is wound. Thus, whatever the configuration of the pattern, and whatever the thickness of the rough frame being wound on it, the wooden strip is not submitted to any bending prior to being adhesively bonded to previously-wound layers on the pattern.

In a different embodiment, the limit switch 15 can be replaced by a pressure switch, not shown, inserted in the closed pneumatic circuit of cylinder 11. To each swing of the bench 6, a corresponding increase in pressure in the cylinder 11 occurs, and when this pressure reaches a predetermined level as the bench 6 reaches the lower dead center position, the pre-calibrated pressure switch will shut off the drive motor 2 so that the rough wooden frame 23 will have the desired thickness. Thus, the pressure switch will achieve the same result as the limit switch 15.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A machine for manufacturing curvilinear convex wooden frames of a desired thickness comprising a base frame, a strip guiding and feeding bench rockably mounted on the base frame and having an upper surface on which a wooden strip can be supported, a variable profile curvilinear pattern mounted on the base frame above a swinging end portion of the bench, means to drive the pattern in rotation so that a wooden strip attached to the pattern can be wound thereon as the strip is pulled across said bench, and yielding biasing means connected with the bench enabling the bench to gradually move away from the axis of the revolving pattern due to an increase in thickness of a wooden frame being produced, said yielding biasing means allowing the bench to oscillate relative to the base frame in synchronism with the revolving of the pattern, whereby the bench can maintain the feeding plane of a wooden strip being wound on the revolving pattern tangent to the pattern.

2. A machine for manufacturing curvilinear convex wooden frames as defined in claim 1, and the rocking axis of said bench being spaced from and parallel to the rotational axis of said pattern and spaced from the tangency point of a strip resting on the bench with said pattern.

3. A machine for manufacturing curvilinear convex wooden frames as defined in claim 2, and a pressing roller on the swinging end portion of the bench engaging the bottom of the rotating pattern at the tangency point of the strip with said pattern.

4. A machine for manufacturing curvilinear convex wooden frames as defined in claim 3, and a glue tank carried by the swinging end portion of said bench with said pressing roller projecting into the glue within said tank and forming a distributing element for the glue across the exterior surface of the wooden strip being wound on the pattern.

5. A machine for manufacturing curvilinear convex wooden frames as defined in claim 1, and said yielding biasing means comprising a power cylinder connected between the base frame and said bench.

6. A machine for manufacturing curvilinear convex wooden frames as defined in claim 5, and means adjustably connecting said power cylinder to the base frame whereby the height of the power cylinder relative to the rotational axis of the pattern can be adjusted.

7. A machine for manufacturing curvilinear convex wooden frames as defined in claim 1, and said pattern comprising a thin plate side surface element having a slit formed therethrough along a line parallel with the axis of rotation of the pattern, articulated rod elements interconnecting the side surface element with a central hub of the pattern and each consisting of at least two sections.

8. A machine for manufacturing curvilinear convex wooden frames as defined in claim 7, and said thin plate side surface element opposing ends are connected to each other through a connecting rod and a cooperating cam.

9. A machine for manufacturing curvilinear convex wooden frames as defined in claim 8, and said side surface element being connected to a central hub of the revolving pattern by rods each having two sections which are articulated to each other and to the side surface element of the pattern.

10. A machine for manufacturing curvilinear convex wooden frames as defined in claim 1, and a limit switch in the path of movement of said bench and actuated to stop the revolving of the pattern by contact with a part on the bench when the wooden frame on the pattern reaches a certain thickness.

11. A machine for manufacturing curvilinear convex wooden frames as defined in claim 10, and said switch having a feeler element actuated when the swinging end of the bench reaches a lowest dead center position of swing to then stop the rotation of the pattern.

12. A machine for manufacturing curvilinear convex wooden frames as defined in claim 5, and a pressure switch inserted in the circuit of said power cylinder and operable to stop the rotation of the pattern when said bench reaches a predetermined low level of swing in response to a certain thickness of the rough frame on said pattern.

* * * * *

UNITED STATES PATENT OFFICE

CERTIFICATE OF CORRECTION

Patent No. 4,311,176 Dated January 19, 1982

Inventor(s) FIORE B. CAVALLARIN

It is certified that error appears in the above-identified patent and that said Letters Patent are hereby corrected as shown below:

On the title page, Item [30], "Mar. 4, 1980" should read -- Apr. 3, 1980 --.

Signed and Sealed this

*Fifteenth* Day of *June 1982*

[SEAL]

*Attest:*

GERALD J. MOSSINGHOFF

*Attesting Officer* *Commissioner of Patents and Trademarks*